US005763799A

United States Patent [19]

Kimble

[11] Patent Number: 5,763,799

[45] Date of Patent: Jun. 9, 1998

[54] SIMULATED ESCAPEMENT APPARATUS FOR ELECTRONIC KEYBOARD

[75] Inventor: Thomas E. Kimble, Cincinnati, Ohio

[73] Assignee: Baldwin Piano & Organ Co., Inc., Loveland, Ohio

[21] Appl. No.: 736,189

[22] Filed: Oct. 24, 1996

[51] Int. Cl.[6] ..... G10C 3/12; G10H 1/34

[52] U.S. Cl. ..... 84/433; 84/434; 84/720; 84/745

[58] Field of Search ..... 84/720, 745, 433, 84/434

[56] References Cited

U.S. PATENT DOCUMENTS

| | | | |
|---|---|---|---|
| 3,938,642 | 2/1976 | Van Rumpt et al. . | |
| 4,061,067 | 12/1977 | Carbone . | |
| 4,119,008 | 10/1978 | Kimble . | |
| 4,161,129 | 7/1979 | Carbone . | |
| 4,217,803 | 8/1980 | Dodds . | |
| 4,273,017 | 6/1981 | Dodds et al. . | |
| 4,338,848 | 7/1982 | Rhodes . | |
| 4,476,769 | 10/1984 | Kumano . | |
| 4,479,415 | 10/1984 | Haberstumpf . | |
| 4,562,764 | 1/1986 | Marshall . | |
| 4,667,563 | 5/1987 | Wakuda et al. | 84/439 |
| 4,723,471 | 2/1988 | Sugimoto . | |
| 4,840,101 | 6/1989 | Kummer . | |
| 4,854,211 | 8/1989 | Tanaka et al. . | |
| 4,856,407 | 8/1989 | Katsuta . | |
| 4,899,631 | 2/1990 | Baker | 84/719 |
| 5,129,301 | 7/1992 | Bosche, Jr. . | |
| 5,204,486 | 4/1993 | Kim et al. . | |
| 5,374,775 | 12/1994 | Kawamura et al. . | |
| 5,386,083 | 1/1995 | Kawamura . | |
| 5,406,875 | 4/1995 | Tamai et al. | 84/433 |
| 5,567,902 | 10/1996 | Kimble et al. . | |
| 5,574,241 | 11/1996 | Kumano et al. | 84/439 |
| 5,578,782 | 11/1996 | Masubuchi | 84/687 |
| 5,610,352 | 3/1997 | Yamaguchi | 84/435 |
| 5,610,356 | 3/1997 | Koseki et al. | 84/719 |
| 5,696,340 | 12/1997 | Ragni | 84/423 R |

*Primary Examiner*—Michael L. Gellner
*Assistant Examiner*—Daniel Chapik
*Attorney, Agent, or Firm*—Steven J. Rosen

[57] ABSTRACT

An electronic keyboard key apparatus to simulate the feel of escapement includes a longitudinally extending key preferably pivotally mounted on a supporting base, a spring apparatus flexibly disposed between the base and the key for resisting depression of the key with a variable resistive force, a latching apparatus to latch the spring apparatus in connection to the base, and an unlatching apparatus to unlatch the spring apparatus from connection to the base with a predetermined amount of resistive force. The latching apparatus may be a magnetic apparatus disposed between the base and the spring apparatus having one of a magnetic element and a magnetically attracted element fixedly connected to the base and the other fixedly connected to the key. The unlatching apparatus may be a hook apparatus having a hook element and a catch element such that the hook element is able to be engaged with the catch element and one of the hook and the catch elements is fixedly connected to one of the magnetic and magnetically attracted elements which is attached to the spring apparatus and another of the hook and the catch elements is fixedly connected to the key. The catch element is spaced apart a predetermined distance from the hook element when the key is not depressed such that the catch element engages the hook element when the key is depressed a predetermined portion of an allowable amount of travel of the key. A weight may be attached to the key so as to resist depression of the key.

19 Claims, 2 Drawing Sheets

SIMULATED ESCAPEMENT APPARATUS FOR ELECTRONIC KEYBOARD

BACKGROUND OF THE INVENTION

1. Field of the Invention

The present invention relates to electronic keyboards having selectively depressed keys designed to simulate piano playing. In particular, the present invention relates to an apparatus which simulates the feel of escapement mechanisms in an electrically operated musical instrument keyboard.

2. Discussion of the Background Art

Electronic musical instruments frequently use keyboards for determining sounds to be played. A piano-action keyboard provides, in addition to pitch selection, a range of expression generally characterized by a complex function of volume, harmonic structure and envelope which is dependent on the speed and force with which the key is struck. At the same time, a characteristic kinesthetic feedback is provided. The "feel" of a keyboard is a characteristic that is generally of great importance to the player. Various types of electronic keyboard instruments have been developed and disclosed, such as in U.S. Pat. No. 4,217,803, which also discloses some of the drawbacks of such instruments that are used to simulate piano-type instruments. One such drawback is that the electronic keyboard lacks the "feel" of mechanical keyboards which is particularly detrimental to a player conditioned by prior training to prefer the piano-action feel. Conventional piano actions are quite complex in nature and their "feel" is determined by the interaction of a large number of moving parts. Careful adjustment of these actions is required during the manufacturing process and this adds to their cost.

Mechanically operated pianos have keys which have a certain feel to the pianist depressing the keys. A mechanical piano playing technique called "repetition" is known immediately after a hammer has struck a string following the depression of a piano key. The same piano key is depressed again before it completely returns to its original position, thereby, producing the same tone. This playing technique is utilized, for example, when the same tone is to be rapidly and continuously produced for a period of time in a trill-like manner. This is facilitated by a known type of double escapement mechanism and a known type of back check mechanism which are typically incorporated in a conventional grand piano and has been developed for upright pianos as disclosed in U.S. Pat. No. 4,854,211.

Escapement is a characteristic of an acoustic or mechanical piano key system, where the hammer is decoupled from the key during travel. When the key is slowly depressed, escapement is perceived as a "bump" near the end of travel. One important aspect of escapement is that after it occurs, the force required to hold the key down is reduced. If the player is sustaining a handful of notes, escapement makes sustaining of the notes less fatiguing.

An escapement mechanism is used to enable a rapidly repetitive striking of a piano string. It acts according to the speed of depression of a piano key to return a hammer to a predetermined position, which stops the return of the hammer at an intermediate position, or which limits the speed of return of the hammer utilizing the force of a spring or the like. Conventional electronic piano keyboards and key mechanisms fail to provide the feel and kinematic key action to simulate escapement as found on mechanical pianos with escapement mechanisms. Towards this end, the present invention provides a piano-action electronic keyboard and key mechanism that provides a realistic piano-like escapement output response and kinesthetic feedback to the player simulating the escapement feel and response of the keys on a mechanical piano.

SUMMARY OF THE INVENTION

An electronic keyboard key apparatus includes a longitudinally extending key movably mounted on a supporting base (preferably in a pivotal manner), a spring apparatus flexibly disposed between the base and the key for resisting depression of the key with a variable resistive force, a latching apparatus to latch the spring apparatus in connection to the base, and an unlatching apparatus to unlatch the spring apparatus from connection to the base with a predetermined amount of resistive force. The latching apparatus may be a magnetic apparatus disposed between the base and the spring apparatus such as a magnetic element and a magnetically attracted element. One of the magnetic and the magnetically attracted elements is fixedly connected to the base and another of the magnetic and magnetically attracted elements is fixedly connected to the key. The unlatching apparatus may be a hook apparatus having a hook element and a catch element such that the hook element is able to be engaged with the catch element and one of the hook and the catch elements is fixedly connected to one of the magnetic and magnetically attracted elements which is attached to the spring apparatus and another of the hook and the catch elements is fixedly connected to the key. Preferably, the catch element is spaced apart a predetermined distance from the hook element when the key is not depressed such that the catch element engages the hook element when the key is depressed a predetermined portion of an allowable amount of travel of the key. A weight may be attached to the key so as to resist depression of the key.

In a more particular embodiment of the present invention, the spring apparatus is a strip spring apparatus flexibly disposed between the key and one of the magnetic and magnetically attracted elements fixedly connected to the strip spring apparatus such as a strip spring fixedly connected to the key at one end of the strip spring and fixedly connected to a first end of a bar at a second end of the strip spring. One of the magnetic and magnetically attracted elements is attached to a second end of the bar. In another more particular embodiment, the magnetic element is attached to the base, a magnetically attracted metal hook having a first portion is disposed over the magnetic element and is fixedly connected to the strip spring, and the magnetically attracted metal hook has the hook element bent over the catch element that is on the key.

In another more particular embodiment of the present invention, the spring apparatus has a bar pivotally attached to the key at one end of the strip element, a coil spring flexibly disposed between the key and the bar so as to resist pivoting of the bar with respect to the key, one of the magnetic and magnetically attracted elements disposed on the bar near a second end of the bar, and the catch at the second end of the bar. In one embodiment, the magnetic element is attached to the base, the bar is a magnetically attracted metal bar having a first portion disposed over the magnetic element, the catch is formed at a second end of the bar, and the hook element is bent under the catch. The catch element is spaced apart a predetermined distance from the hook element when the key is not depressed such that the catch element engages the hook element when the key is depressed a predetermined portion of an allowable amount of travel of the key. Another embodiment further includes a pin extending away from the key and disposed through an aperture in the bar and the coil spring is disposed around the pin. A pin head may be used at a distal end of the pin away from the key with the coil spring disposed in compression between the bar and the pin head and the pin may be a wood screw. A cushioning device, preferably made of felt, may be disposed between the key and the second end of the bar such as to be attached to one of and disposed between the hook and catch elements.

ADVANTAGES OF THE INVENTION

The present invention has the advantage over conventional electronic keyboards that simulate pianos because it provides a more realistic feel to the keys. It provides a more realistic feel for a piano playing technique called "repetition", a playing technique in which the same tone is to be rapidly and continuously produced for a short period of time in a trill-like manner.

The present invention has the ability to provide electronic keyboards with a simulated feel of an escapement mechanism found in mechanical pianos. Unlike conventional electronic piano keyboards, the present invention provides a key mechanisms that produces the feel and kinematic key action to simulate escapement as found on mechanical pianos with escapement mechanisms.

BRIEF DESCRIPTION OF THE DRAWINGS

The novel features believed characteristic of the present invention are set forth and differentiated in the claims. The invention, together with further objects and advantages thereof, is more particularly described in conjunction with the accompanying drawings in which:

DETAILED DESCRIPTION

Figure 1:
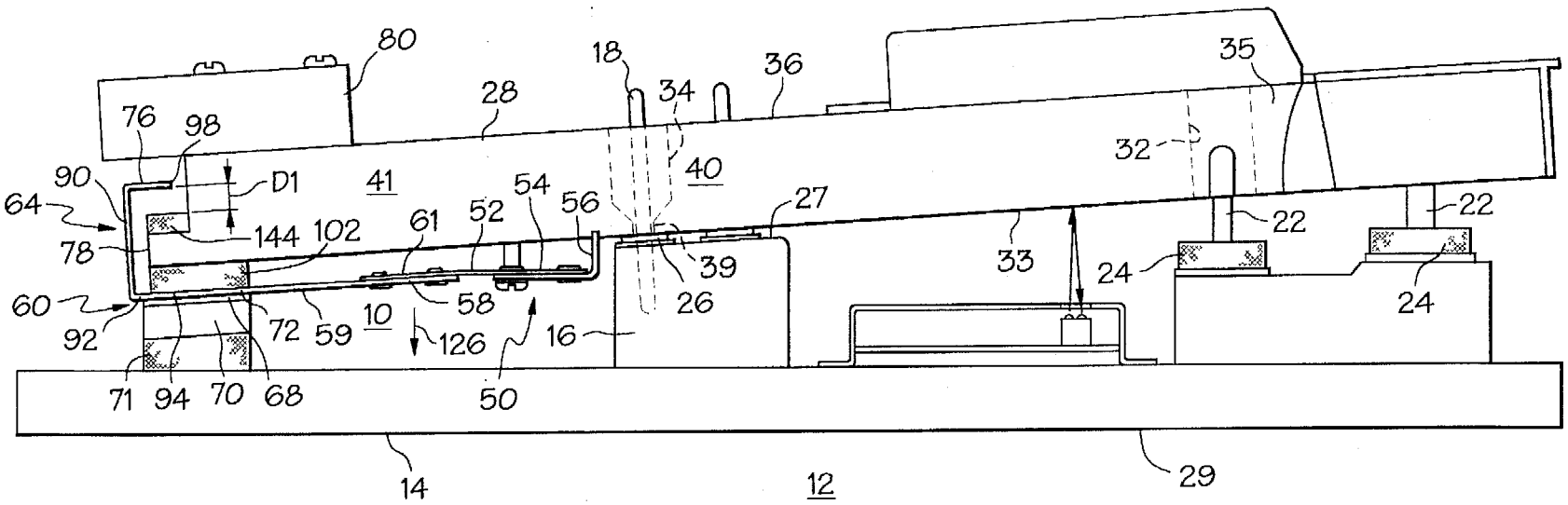
FIG. 1 is a side elevation view in section of the electronic keyboard key apparatus in accordance with an exemplary embodiment of the present invention.

Referring now to the drawings in detail wherein identical numerals indicate the same elements throughout the figures. FIG. 1 illustrates an electronic keyboard key apparatus of the present invention generally shown at 10 incorporated in an electronic piano-type keyboard 12 (shown in part). The keyboard 12 includes a keyed frame 14 which provides a base for supporting a fulcrum 16 from which a pivot pin 18 extends vertically upward from the fulcrum. A sound damping felt washer 26 is positioned around the pivot pin 18 and resting on an upper surface 27 of the fulcrum 16. At a forward end 29 of the keybed frame 14 is a guide pin 22 that extends vertically upward from and is secured to the frame. A damping cushion 24, preferably made of felt, is positioned around the guide pin 22.

Figure 2:
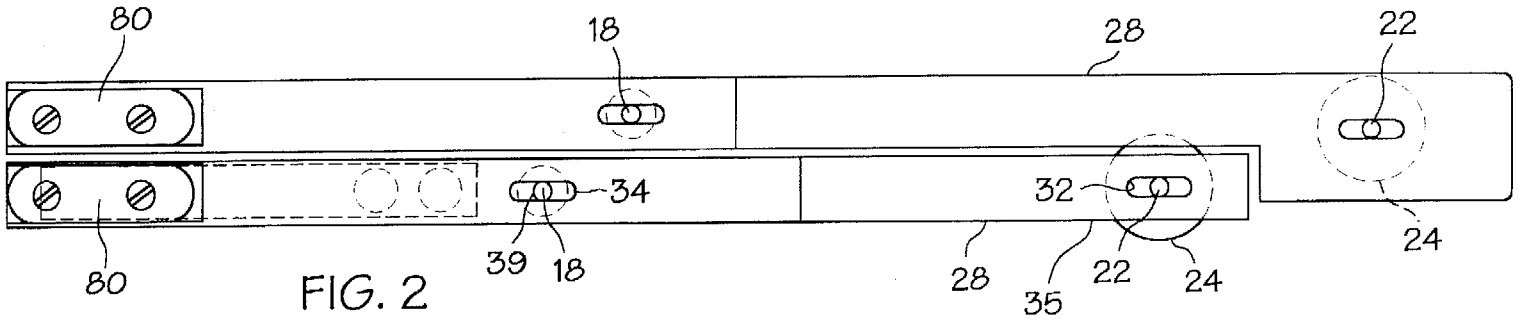
FIGS. 2 is a side elevation view in section of the electronic keyboard key apparatus in accordance with an alternative embodiment of the present invention.

A movable keyboard key 28 is illustrated in the preferred embodiment as pivotably mounted with respect to the base or frame 14. The key 28 rests on the felt washer 26 on the fulcrum 16 and is held in position by the guide pin 22 and the pivot pin 18. The keyboard key 28 is provided with an elongated first slot 32 in its underside 33 at a forward end 35 of the key, and an elongated second slot 34 extending downward from the key top surface 36 at a generally mid position 40 of the key. A hole 39 is provided at the bottom of the second slot 34 and the pivot pin 18 extends upward through the hole and into the slot. The pivot pin's extending through the hole 39 and into the second slot 34 provides the pivoting connection of the keyboard key 28 on the fulcrum 16 of the keybed frame 14. The guide pin 22 extends upward from the keybed frame 14 into the forward first slot 32. The pivot pin 18 and the guide pin 22 permit the up and down pivoting movement of the forward end 35 and the rearward end 41 of the key 28 on the fulcrum 16 while preventing side-to-side movement of the key 28, thereby, maintaining all adjacent keys 28 in the keyboard parallel to each other while permitting the keys to be depressed downward as illustrated in FIG. 2.

The embodiment of the present invention illustrated in FIG. 1 shows the electronic keyboard key apparatus 10 having a spring apparatus 50 flexibly disposed between the frame 14 and the key 28 for resisting depression of the key with a variable resistive force. This embodiment provides a strip spring 52 as the spring apparatus 50 bolted at a first spring end 54 to a mounting lug 56 which is secured to the underside 33 of the key 28. The strip spring 52 is fixedly connected to a first bar end 58 of a bar 59 at a second spring end 61 of the strip spring. The bar 59 serves as the magnetically attracted element 72 and magnetic element 70, illustrated in this embodiment as a bar magnetic, is mounted on a pedestal 71.

A latching apparatus 60 is provided to latch the strip spring 52 to the frame 14 and an unlatching apparatus 64 to unlatch the spring apparatus from the frame 14 with a predetermined amount of resistive force. The latching apparatus is preferably a magnetic apparatus 68 disposed between the frame 14 and the strip spring 52 and includes a magnetic element 70 and a magnetically attracted element 72. One of the magnetic and the magnetically attracted elements 70 and 72, respectively, is fixedly connected to the frame 14 and another of the magnetic and magnetically attracted elements is fixedly connected by the strip spring 52 to the key. The unlatching apparatus may be a hook means having a hook element 76 and a catch element 78 such that the hook element is able to be engaged with the catch element and one of the hook and the catch elements is fixedly connected to one of the magnetic and magnetically attracted elements 70 and 72, respectively, which is attached to the strip spring 52 and another of the hook and the catch elements is fixedly connected to the key 28. Preferably, the catch element 78 is spaced apart a predetermined first distance D1 from the hook element 76 when the key 28 is not depressed such that the catch element engages the hook element when the key is depressed a predetermined portion T1 of an allowable amount of travel T of the key. It has been found that one desirable percentage of the predetermined portion Ti to the allowable amount of travel T of the key is about 75%. A weight 80 is attached to the rearward end 41 of the key 28 so as to resist depression of the key.

The bar 59 has a magnetically attracted metal hook 90 at a second bar end 92 of the bar 59. The magnetically attracted metal hook 90 has a first portion 94 disposed over the magnetic element 70 and a hook element 98 bent over the catch element 78 that is formed on rearward end 41 of the key 28. A first cushioning means such as a damping cushion pad 102, preferably made of felt, is attached to the underside 33 of the key 28 and positioned between the key and the second bar end 92. This cushions the key 28 against an impact made by the bar 59 when it is released from being held by the magnetic element 70 when the metal hook 90 is engaged by the catch element 78 as the key is depressed, the predetermined portion T1 of the allowable amount of travel T. This sudden release and subsequent stop of the bar against the damping cushion pad 102 simulates the feel of escapement. A second cushioning means in the form of a damping cushion pad 144, preferably made of felt, or some other apparatus should be disposed between the between the hook and catch elements 76 and 78, respectively.

In operation the weight 80 provides an initial resistance to the depression of the key 28, for example about 50 grams at the key's front. As the key continues to be depressed further the spring means causes the resistance to continues to rise until the key 28 has completed the predetermined portion Ti of the allowable amount of travel T, for example ¾ of T. At this point the resistance is up to a preselected amount, for example 70 grams, when the bar 59 is released from being held by the magnetic element 70 as the metal hook 90 is engaged by the catch element 78 and the resistance returns to that provided by the weight 80, about 50 grams at the key's front in this example.

Figure 3:
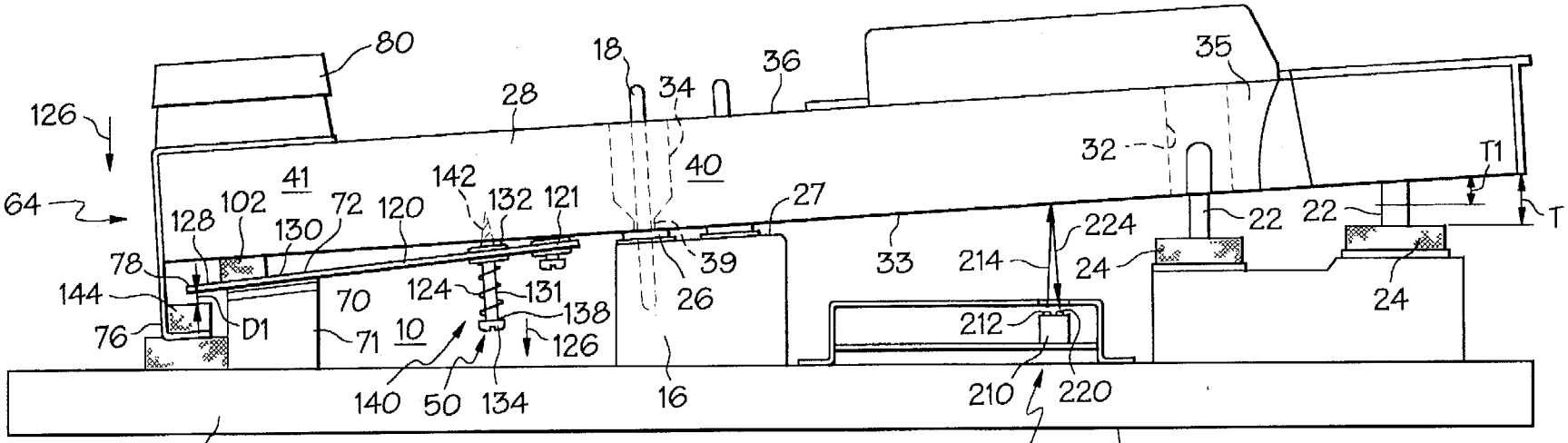
FIG. 3 is a top elevation partial view of adjoining keys in an electronic keyboard in accordance with the present invention.

FIG. 3 illustrates an alternative embodiment of the electronic keyboard key apparatus of the present invention generally shown at 10 incorporated in an electronic piano-type keyboard 12. The spring apparatus 50 has a longer bar 120 pivotally attached at a first end of the bar 121 to the underside 33 of the key 28 between the rearward end 41 of the key 28 and the fulcrum 16. A coil spring 124 is flexibly disposed between the key 28 and the bar 120 so as to resist pivoting of the bar with respect to the key in the downward direction 126. The bar 120 is held down by one of the magnetic and magnetically attracted elements 70 and 72, respectively, disposed on the bar near a second end 128 of the bar 120. The catch element 78 is at the second end 128 of the bar 120. The embodiment disclosed in FIG. 3 illustrates the magnetic element 70 as being attached to the frame 14 on a pedestal 71 and the bar 120 is the magnetically attracted element 72. The metal bar 120 has a first portion 130 disposed over the magnetic element 70 and the catch element 78 is formed at the second end 128 of the bar. The hook element 76 is bent under the catch element 78. Preferably, the catch element 78 is spaced apart a predetermined first distance D1 from the hook element 76 when the key is not depressed such that the catch element is engaged by the hook element when the key is depressed a predetermined portion T1 of an allowable amount of travel T of the key. A weight 80 is attached to the rearward end 41 of the key 28 so as to resist depression of the key. It has been found that one desirable percentage of the predetermined portion T1 to the allowable amount of travel T of the key is about 75%.

A pin 131 extends away from the underside 33 of the key 28 and is disposed through a grommeted aperture 132 in the bar 120 and the coil spring is disposed around the pin. A pin head 134 at a distal end 138 of the pin away from the key 28 engages the coil spring 124 placing it in compression between the bar 120 and the pin head 134. A means for adjusting tension in the coil spring 124 may be provided by having the pin 131 be a wood screw 140, with a screw tip 142, and a slotted pin head 134 or some other means for turning the screw into the wood of the key 28.

A first cushioning means, such as damping cushion pad 102, is attached to the underside 33 of the key 28 and positioned between the key and the second end 128 of the bar 120. This cushions the key 28 against an impact made by the bar 120 when the bar is released from being held by the magnetic element 70 when the hook element 76 engages the catch element 78 as the key is depressed, the predetermined portion T1 of the allowable amount of travel T. This sudden release and subsequent stop of the bar against the damping cushion pad 102 simulates the feel of escapement.

A second cushioning means in the form of another damping cushion pad 144 or some other cushioning device should be disposed between the hook and catch elements 76 and 78 the key 28. The damping cushion pad 144 is preferably attached to the hook element 76 which is bent under the catch element 78 as illustrated in FIG. 3.

An exemplary detecting means 200 for detecting movement of the key 28 is positioned on the frame 14 beneath the key 28 as illustrated in FIGS. 1 and 3. The detecting means 200 is explained in much greater detail in U.S. Pat. No. 5,567,902, issued Oct. 22, 1996, and entitled "METHOD AND APPARATUS FOR OPTICALLY SENSING THE POSITION AND VELOCITY OF PIANO KEYS" which is incorporated herein by reference. As an optoelectronic device 210 having a light emitting diode (LED) 212 is positioned beneath each of the keys and emits light 214 against the underside 33 of each key. A phototransistor 220 is positioned to detect reflected light 224 off of that key. Many other well known means are available to detect position and movement of keys 28 to provide a signal for use by an electrically operated musical instrument and electronic keyboard.

While the preferred embodiment of our invention has been described fully, in order to explain its principles, it is understood that various modifications or alterations may be made to the preferred embodiment without departing from the scope of the invention as set forth in the appended claims.

What is claimed is:

1. An electronic keyboard key apparatus comprising:

a longitudinally extending key movably mounted on a supporting base, a spring means flexibly disposed said base and said key for resisting depression of said key with a variable resistive force, a latching means to latch said spring means in connection to said base, said latching means comprising a magnetic means disposed between said base and said spring means, and an unlatching means to unlatch said spring means from connection to said base with a predetermined amount of resistive force.

2. An apparatus as claimed in claim 1 wherein said magnetic means comprises a magnetic element and a magnetically attracted element wherein one of said magnetic and said magnetically attracted elements is fixedly connected to said base and another of said magnetic and magnetically attracted elements is fixedly connected to said key.

3. An apparatus as claimed in claim 2 wherein said unlatching means is a hook means.

4. An apparatus as claimed in claim 3 wherein said hook means comprises a hook element and a catch element wherein said hook element is engageable with said catch element and one of said hook and said catch elements is fixedly connected to one of said magnetic and magnetically attracted elements which is attached to said spring means and another of said hook and said catch elements is fixedly connected to said key.

5. An apparatus as claimed in claim 4 wherein said catch element is spaced apart a predetermined distance from said hook element when said key is not depressed such that said catch element engages said hook element when said key is depressed a predetermined portion of an allowable amount of travel of said key.

6. An apparatus as claimed in claim 5 further comprising a weight attached to said key so as to resist depression of said key.

7. An apparatus as claimed in claim 5 wherein said spring means is a strip spring means flexibly disposed between said key and one of said magnetic and magnetically attracted elements fixedly connected to said strip spring means.

8. An apparatus as claimed in claim 7 wherein said strip spring means comprises:

a strip spring fixedly connected to said key at one end of said strip spring and fixedly connected to a first end of a bar at a second end of said strip spring, and one of said magnetic and magnetically attracted elements is attached to a second end of said bar.

9. An apparatus as claimed in claim 8 further comprising:

said magnetic element attached to said base, a magnetically attracted metal hook having a first portion disposed over said magnetic element and fixedly connected to said strip spring, and said magnetically attracted metal hook having said hook element bent over said catch element disposed on said key.

10. An apparatus as claimed in claim 9 further comprising a weight attached to said key so as to resist depression of said key.

11. An apparatus as claimed in claim 5 wherein:

said catch is a bar pivotally attached to said key at one end of said strip element, said spring means is a coil spring flexibly disposed between said key and said bar so as to resist pivoting of said bar with respect to said key, and one of said magnetic and magnetically attracted elements is disposed on said bar near a second end of said bar.

12. An apparatus as claimed in claim 11 further comprising:

said magnetic element attached to said base, said bar being a magnetically attracted metal bar having a first portion disposed over said magnetic element, said catch formed at a second end of said bar, and said hook element being bent under said catch.

13. An apparatus as claimed in claim 12 wherein said catch element is spaced apart a predetermined distance from said hook element when said key is not depressed such that said catch element engages said hook element when said key is depressed a predetermined portion of an allowable amount of travel of said key.

14. An apparatus as claimed in claim 13 further comprising a pin extending away from said key and disposed through an aperture in said bar and said coil spring is disposed around said pin.

15. An apparatus as claimed in claim 14 further comprising a pin head at a distal end of said pin away from said key and said coil spring is disposed in compression between said bar and said pin head.

16. An apparatus as claimed in claim 15 wherein said pin a wood screw.

17. An apparatus as claimed in claim 16 further comprising a weight attached to said key so as to resist depression of said key.

18. An apparatus as claimed in claim 11 further comprising a cushioning means disposed between said key and said second end of said bar.

19. An apparatus as claimed in claim 5 further comprising a cushioning means attached to one of and disposed between said hook and catch elements.

* * * * *